US005983060A

United States Patent [19]

Namekata et al.

[11] Patent Number: 5,983,060

[45] Date of Patent: Nov. 9, 1999

[54] IMAGE FORMING APPARATUS WHICH REMOVES A SURFACE POTENTIAL OF AN INTERMEDIATE TRANSFER MEMBER

[75] Inventors: Shin-Ichi Namekata, Yokohama; Hideo Yuu, Tama; Satoru Uchida, Tokyo; Mitsuru Takahashi, Kawasaki; Katsuya Kawagoe, Kamakura; Hiroshi Ono, Yokohama; Toshiaki Motohashi, Souka, all of Japan

[73] Assignee: Ricoh Company, Ltd., Tokyo, Japan

[21] Appl. No.: 09/050,907

[22] Filed: Mar. 31, 1998

[30] Foreign Application Priority Data

| | | | |
|---|---|---|---|
| Mar. 31, 1997 | [JP] | Japan | 9-098064 |
| Mar. 31, 1997 | [JP] | Japan | 9-098065 |
| Mar. 31, 1997 | [JP] | Japan | 9-098067 |

[51] Int. Cl.[6] ..... G03G 15/16

[52] U.S. Cl. ..... 399/297; 399/66

[58] Field of Search ..... 399/297, 298, 399/302, 308, 310, 315, 66

[56] References Cited

U.S. PATENT DOCUMENTS

| | | | |
|---|---|---|---|
| 4,737,821 | 4/1988 | Suzuki et al. . | |
| 5,083,160 | 1/1992 | Suzuki et al. . | |
| 5,189,478 | 2/1993 | Hara et al. | 399/66 |
| 5,541,717 | 7/1996 | Saito et al. | 399/150 |
| 5,697,031 | 12/1997 | Kamiya et al. | 399/66 X |
| 5,701,566 | 12/1997 | Bisaiji et al. . | |
| 5,758,226 | 5/1998 | Motohashi | 399/66 |

FOREIGN PATENT DOCUMENTS

| | | |
|---|---|---|
| 61-43773 | 3/1986 | Japan . |
| 10-26890 | 1/1988 | Japan . |
| 1-38765 | 2/1989 | Japan . |
| 7-168411 | 7/1995 | Japan . |
| 8-272231 | 10/1996 | Japan . |
| 10-91011 | 4/1998 | Japan . |

*Primary Examiner*—Arthur T. Grimley
*Assistant Examiner*—Quana Grainger
*Attorney, Agent, or Firm*—Oblon, Spivak, McClelland, Maier & Neustadt, P.C.

[57] ABSTRACT

An image forming apparatus which utilizes an intermediate transfer member. Plural toner images, for example of different colors, can be superimposed on the intermediate transfer member, and then can be transferred to a paper sheet. A discharging device is provided for discharging a charge applied to the intermediate transfer member. Further, a value of a voltage provided by this discharging device and/or a voltage provided for a transfer bias is proportional to an actual surface potential on the intermediate transfer member, which is proportional to the number of times toner images have been formed on the intermediate transfer member prior to transfer to the paper sheet. For example, if a full color toner image is formed on the intermediate transfer member, which may result from four operations of transferring individual toner images onto the intermediate transfer member, a voltage provided by the discharger and/or by a transfer bias device will be higher than that if only a monocolor image has been formed on the intermediate transfer member. Further, the image forming apparatus can be operable to form images on thicker paper, and in this instance a drive speed of devices in the image forming apparatus can be reduced, and a voltage applied to a pre-charger can also accordingly be reduced. The image forming apparatus can also include a cleaning device from the intermediate transfer belt, and the functions of both the intermediate transfer member discharging device and a cleaning device can be combined in one brush roller.

50 Claims, 5 Drawing Sheets

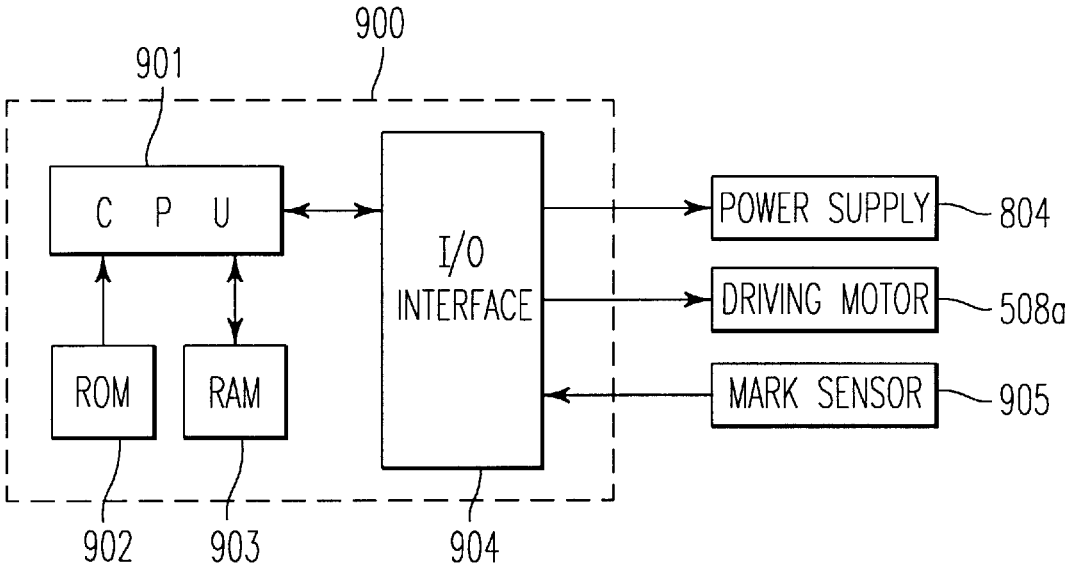
FIG. 4
FIG. 5A
FIG. 5B
FIG. 5C
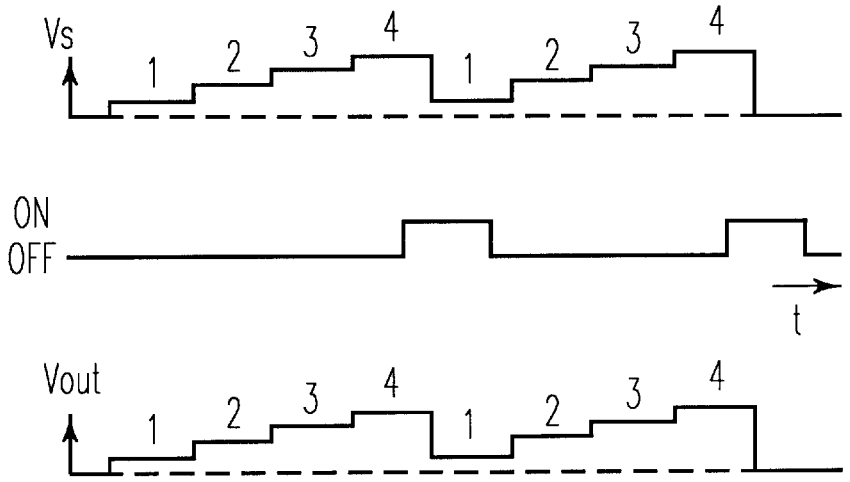

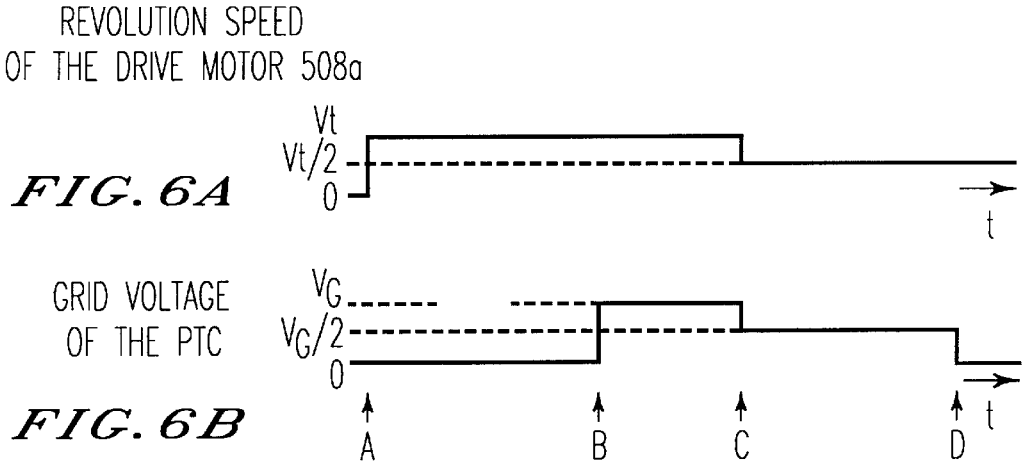
FIG. 6A
FIG. 6B
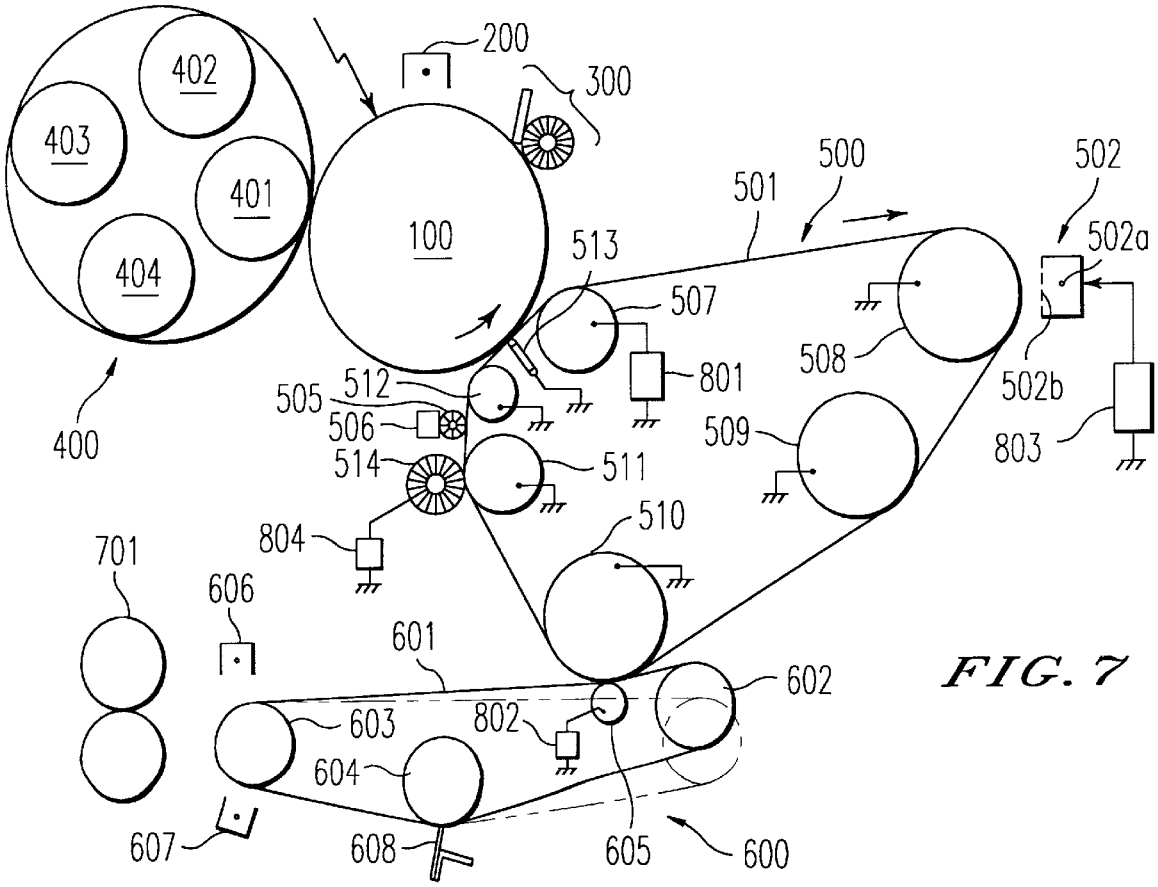
FIG. 7

IMAGE FORMING APPARATUS WHICH REMOVES A SURFACE POTENTIAL OF AN INTERMEDIATE TRANSFER MEMBER

BACKGROUND OF THE INVENTION

1. Field of the Invention

The present invention relates to an image forming apparatus such as a copying machine, a printer, a facsimile, etc., and more particularly to an image forming apparatus in which an intermediate transfer member is used.

2. Discussion of the Background

A background image forming apparatus includes the following elements: an intermediate transfer member for bearing a toner image transferred from an image bearing member, a primary transfer charger for applying a charge to the intermediate transfer member for transferring the toner image from the image bearing member to the intermediate transfer member, a secondary transfer charger for applying a charge to a final transfer member, e.g. a paper sheet, for transferring the toner image from the intermediate transfer member to the final transfer member and an intermediate transfer member discharging device for removing a charge from a surface of the intermediate transfer member which has transferred the toner image to the final transfer member. In such an image forming apparatus, a surface potential of the intermediate transfer member is made uniform by removing the charge from the surface of the intermediate transfer member with the intermediate transfer member discharging device to prepare for a next primary transferring operation from the image bearing member to the intermediate transfer member.

However, in some cases in the above-mentioned background image forming apparatus, the surface potential of the intermediate transfer member will not be at a desired predetermined potential, or an irregular potential remains after removing the charge from the intermediate transfer member with the intermediate transfer member discharging device. These states of defective discharging deteriorate any subsequent transfer process from the image bearing member to the intermediate transfer member.

As a result of an investigation of a cause of the defective discharging on the intermediate transfer member made by the inventors of the present invention, it has been determined that a main cause of the defective discharging is significant unevenness of the surface potential of the intermediate transfer member whose charge has not been effectively removed by the intermediate transfer member discharging device.

This unevenness may particularly occur if the image forming apparatus is a color image forming device constructed so that the primary transferring operation is performed a plurality of times to superimpose toner images of various colors, which have been formed on the image bearing member, onto the intermediate transfer member, and in which then the toner images superimposed on the intermediate transfer member are transferred to the final transfer member at one time. In this case, the surface potential of the intermediate transfer member whose charge has not been removed by the intermediate transfer member discharging device may be uneven. Further, the degree of unevenness may depend on the number of the toner images superimposed on the intermediate transfer member, in other words, the number of times the primary transfer to the intermediate transfer member is executed.

Further, in such a background image forming apparatus, a transfer condition for transferring the toner image on the intermediate transfer member to the final transfer member is set to be almost at a center of a preferable transfer range in which a transfer rate to the final transfer member is normally set to a predetermined value or greater. A difference between a set value of this transfer condition and an upper limit of the preferable transfer range or a lower limit thereof corresponds to a transfer allowance for transferring the toner image on the intermediate transfer member to the final transfer member. As this difference is increased, the transfer allowance becomes greater.

If a toner image which has passed through a primary transfer section, which transfers the toner image from the image bearing member to the intermediate transfer member, includes portions having different amounts of adhering toner, unevenness of a charged amount occurs in the toner image on the intermediate transfer member. For example, if the toner image on the intermediate transfer member includes a solid portion and a halftone portion, a charged amount of the solid portion may be lower than that of the halftone portion. Furthermore, for example, in a color image forming apparatus is used, a charged amount of a portion where toner of a plurality of colors is superimposed in the toner image on the intermediate transfer member is lower than that of a portion where toner of only a single color adheres to the intermediate transfer member.

In addition, unevenness of the charged amount in the toner image is sometimes caused by a peeling discharge which occurs downstream adjacent to the primary transfer section in a surface moving direction of the intermediate transfer member after the toner image has passed through the primary transfer section for transferring the toner image from the image bearing member to the intermediate transfer member.

If there is unevenness of a charged amount in the toner image on the intermediate transfer member as described above, the toner image contains portions having different transfer characteristics. If an attempt is made to transfer all the portions having the different transfer characteristics to the transfer member under the same transfer conditions, a range of the transfer condition over which the entire toner image can be transferred at a transfer rate greater than a predetermined value is narrowed. As a result, the transfer allowance for the entire toner image is decreased, and thereby the toner image cannot be transferred stably to the final transfer member.

Referring to FIG. 9, a graph of transfer characteristics is shown with curved lines a and b indicating relationships between a transfer current and a transfer rate for a solid portion and a halftone portion, respectively. Widths indicated by reference numerals A and B in FIG. 9 correspond to ranges of a transfer current which allows respective portions to be transferred to a final transfer member at a transfer rate of 80% or greater, and the transfer allowances are relatively high. However, a range of a transfer current which allows both of these two portions to be transferred at a transfer rate of 80% or greater is narrow as indicated by reference numeral C in FIG. 9 due to a deviation of the two curves a, b, and therefore a transfer allowance is lowered. That is, an overlapping of curves A and B, which is a range which allows both solid and halftone image portions to be effectively transferred, is narrow, which thereby lowers a transfer allowance.

As a further drawback, a background image forming apparatus requires both an intermediate transfer member discharging device, such as a corona discharger, for removing charges on a surface of the intermediate transfer member and a cleaning device, such as a cleaning blade, for removing deposits on the surface of the intermediate transfer member individually, and therefore it is difficult to reduce the cost of such a background device.

SUMMARY OF THE INVENTION

Accordingly, one object of the present invention is to provide a novel image forming apparatus utilizing an intermediate transfer member which can ensure the proper transfer of images to and from the intermediate transfer member and which can achieve such a structure with high efficiency and reduced cost.

A more specific object of the present invention is to provide a novel image forming apparatus which can remove a charge on an intermediate transfer member uniformly after toner images are transferred to a transfer member so as to prepare for a next transferring operation of a toner image from an image bearing member.

A further more specific object of the present invention is to provide a novel image forming apparatus which can transfer a toner image stably to a transfer member even if there is unevenness of a charged amount in the toner image on an intermediate transfer member after being transferred from an image bearing member, by restraining a decrease of a transfer allowance for transferring the toner image to the transfer member.

A further more specific object of the present invention is to provide a novel image forming apparatus which can be realized at a lower cost, by including a novel conductive brush section which serves as both an intermediate transfer member discharging device and an intermediate transfer member cleaning device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 4 is a block diagram of a control of a belt discharger in the color copying machine of FIG. 1;

FIGS. 5(*a*), 5(*b*), 5(*c*) are timing charts illustrating a change of a surface potential of the intermediate transfer belt, an ON/OFF timing of a belt discharger and an output of a primary transfer bias device in FIG. 1;

FIGS. 6(*a*) and 6(*b*) are timing charts illustrating a correlation between a revolution speed of a drive motor and a grid voltage applied to a precharger in an embodiment of the present invention;

FIG. 7 shows a schematic construction diagram illustrating a color copying machine according to a further embodiment of the present invention;

DESCRIPTION OF THE PREFERRED EMBODIMENTS

Preferred embodiments of the present invention will now be described for a case that the present invention is applied to an electrophotographic color copying machine (hereinafter referred to as a color copying machine) as an image forming apparatus. The present invention can of course be applied to other image forming devices.

Figure 1:
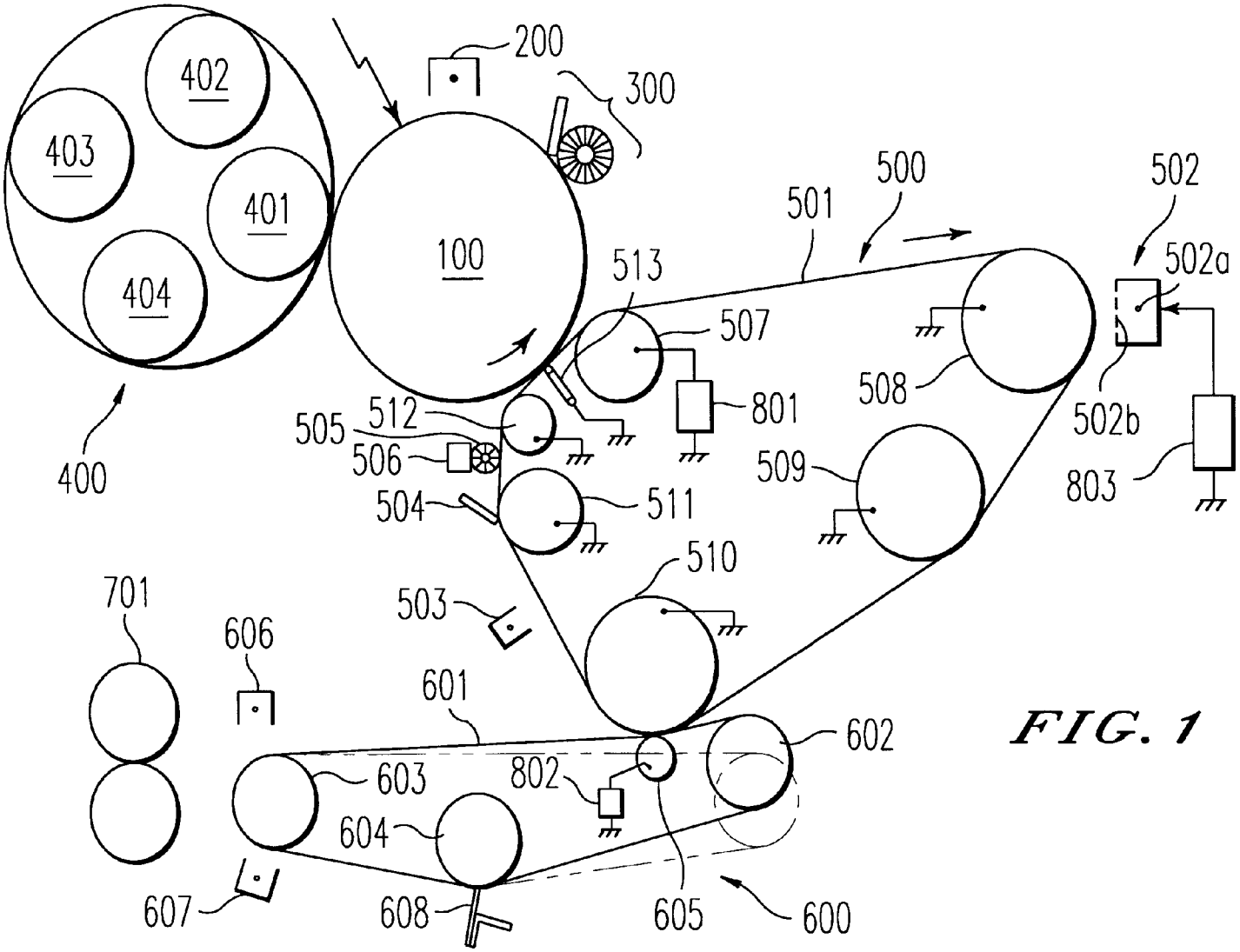
FIG. 1 is a schematic construction diagram illustrating a color copying machine according to an embodiment of the present invention.

FIG. 1 shows a schematic construction of an image forming section as a main part of a color copying machine of an embodiment of the present invention. This color copying machine also includes (although not shown) a color image reading section (hereinafter referred to as a color scanner), a feeding section, and a control section.

A color scanner reads color image information of an original document for each resolved color light of, for example, red, green, and blue (hereinafter referred to as R, G, and B, respectively) and then converts the color image information to electric image signals. Then, a color conversion processing operation is performed in an image processing section (not shown) based on intensity levels of the resolved color image signals of R, G, and B obtained by the color scanner, so as to obtain color image data of black, cyan, magenta, and yellow (hereinafter referred to as Bk, C, M, and Y, respectively).

The image forming section in FIG. 1 includes a photoconductive drum 100 acting as an image bearing member, a charger 200, a photoconductive element cleaner 300 composed of a cleaning blade and a fur brush, an optical writing unit acting as an exposing device (not shown), a revolver type developing unit 400, an intermediate transfer unit 500, a paper transfer unit 600, and a fixing unit composed of a pair of fixing rollers 701.

The photoconductive drum 100 rotates in a counterclockwise direction indicated by an arrow. Positioned around the photoconductive drum 100 are the charger 200, the photoconductive element cleaner 300, a selected developing device in the revolver type developing unit 400, and an intermediate transfer belt 501 of the intermediate transfer unit 500.

An optical writing unit converts color image data from the color scanner to optical signals, and optically writes data corresponding to images of an original document on a surface of the photoconductive drum 100, which has been uniformly charged by the charger 200, to thereby form electrostatic latent images on the photoconductive drum 100. This optical writing unit may include, for example, a semiconductor laser (laser diode) as a light source, a laser light emitting driving control section, a polygon mirror and a motor rotating therefor, a f/θ lens, and a reflecting mirror.

The revolver type developing unit 400 includes a Bk developing device 401 in which Bk toner is stored, a C developing device 402 in which C toner is stored, a M developing device 403 in which M toner is stored, a Y developing device 404 in which Y toner is stored, and a developing revolver driving section for rotating the entire unit 400 in, e.g., the counterclockwise direction. Each developing device disposed in this revolver type developing unit 400 includes a developing sleeve as a developer carrier which rotates with respective developer in contact with the surface of the photoconductive drum 100 to develop the electrostatic latent images formed on the photoconductive drum 100, a developer paddle rotating for scooping up and stirring respective developer, and a developing roller driving section for rotating a developing roller in, e.g., a clockwise direction.

In this embodiment, toner in each developing device 401–404 is charged to a negative polarity by being stirred with a ferrite carrier. Further, a developing bias voltage, which is obtained by superimposing an AC voltage Vac (AC component) on a negative DC voltage Vdc (DC component), is applied to each developing sleeve by a developing bias power supply (not shown), so that the developing sleeve is biased to a predetermined potential relative to a metallic substrate layer of the photoconductive drum 100.

In a waiting state of the color copying machine, the revolver type developing unit 400 is stopped at a home position where the Bk developing device 401 is located at a developing position. When a copying operation is started, a color scanner starts to read Bk color image data at a predetermined timing, and then optical writing with a laser light and formation of electrostatic latent images are started based on this color image data (hereinafter, an electrostatic latent image based on the Bk image data is referred to as a Bk electrostatic latent image; this same terminology is applied for C, M, and Y electrostatic latent images.). Before a leading edge of the electrostatic latent image reaches a Bk developing position, the Bk developing sleeve is started to rotate to develop the Bk electrostatic latent image with Bk toner so that the Bk electrostatic latent image can be developed from its leading edge. The developing operation is continued for the Bk electrostatic latent image area such that the revolver type developing unit 400 rotates until a developing device of a next color reaches the developing position when a trailing edge of the Bk electrostatic latent image passes past the Bk developing position. This operation is completed no later than the time before the leading edge of the electrostatic latent image based on the next image data reaches the developing position.

The intermediate transfer unit 500 composed of the intermediate transfer belt 501 is movably positioned around a plurality of rollers, or the like. The following elements are disposed around intermediate transfer belt 501: a pre-transfer charger 502 (hereinafter referred to as PTC 502), a secondary transfer belt 601, which transports a transfer member, of a paper transfer unit 600, a secondary transfer bias roller 605 to apply a secondary transfer charge, a belt discharger 503 to discharge a charge on the intermediate transfer belt 501, a belt cleaning blade 504 to clean the intermediate transfer belt 501, and a lubricant applying brush 505 for applying lubricant to the intermediate transfer belt 501. As shown in FIG. 7, and as discussed in further detail below, a brush roller 514 can also be disposed around the intermediate transfer belt 500 to serve as both an intermediate transfer belt 501 discharging device and as an intermediate transfer member cleaning device.

The intermediate transfer belt 501 is movably positioned around a primary transfer bias roller 507 which acts a primary transfer charger, a belt driving roller 508, a belt tension roller 509, a secondary transfer facing roller 510, a cleaning facing roller 511, and a belt discharging roller 512 which acts as a primary pre-transfer discharging device. Each roller is made of a conductive material, and respective rollers other than the primary transfer bias roller 507 are grounded. A transfer bias is applied to the primary transfer bias roller 507 to control a predetermined level of current or voltage according to a number of superimposed toner images under control from a primary transfer power supply 801 controlled at a constant current or a constant voltage. The intermediate transfer belt 501 is driven in the direction indicated by an arrow by the belt driving roller 508, which is driven to rotate by a driving motor (not shown).

Figure 2:
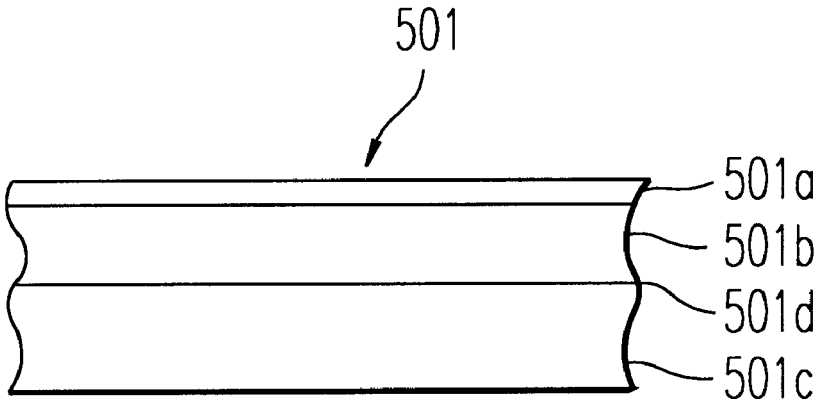
FIG. 2 is a sectional view illustrating an intermediate transfer belt used for the color copying machine of FIG. 1.

As shown in a cross-sectional view in FIG. 2, the intermediate transfer belt 501 can be made of a belt-shaped member having a multi-layer construction of a surface layer 501*a*, an intermediate layer 501*b*, and a base layer 501*c*. The surface layer 501*a* is at a side of an outer circumferential surface which is in contact with the photoconductive drum 100, and the base layer 501*c* is at an inner circumferential surface. In addition, between the intermediate layer 501*b* and the base layer 501*c*, a bonding layer 501*d* is provided for bonding these layers.

At a transfer section for transferring toner images from the photoconductive drum 100 to the intermediate transfer belt 501 (hereinafter referred to as a primary transfer section), the intermediate transfer belt 501 is pressed toward the photoconductive drum 100 by the primary transfer bias roller 507 and the belt discharging roller 512 to form a nip portion of a predetermined width between the photoconductive drum 100 and the intermediate transfer belt 501. In addition, a grounded belt discharging brush 513 which acts as a primary transfer section discharging device contacts an inner circumferential surface of the intermediate transfer belt 501 at this nip portion.

Figure 3:
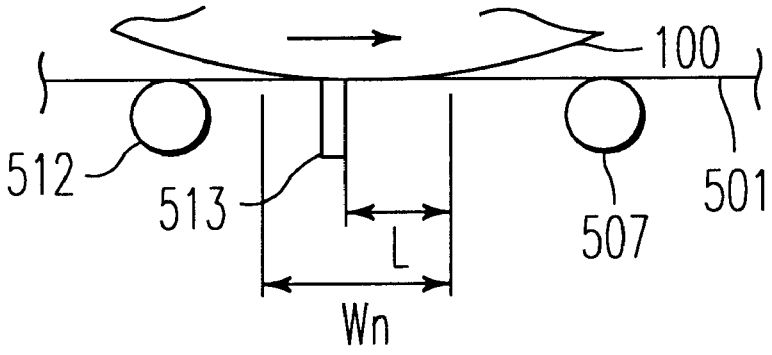
FIG. 3 is an enlarged view of a primary transfer section of the color copying machine of FIG. 1.

Furthermore, as shown in FIG. 3, a nip width Wn at the primary transfer section and a distance L from a downstream end in a moving direction of the belt 501 at the nip portion to the contact position of the belt discharging brush 513 with the intermediate transfer belt 501 can be set to obtain desired transfer conditions.

Again with reference to FIG. 1, PTC 502 applies a pre-charge to the photoconductive drum 100 to evenly charge a toner image on the intermediate transfer belt 501 which has been transferred from the photoconductive drum 100 in the primary transfer section before the toner image is transferred to a transfer paper.

The belt discharger 503 applies either only an AC voltage or an AC plus DC voltage to the intermediate transfer belt 501. In addition, the belt cleaning blade 504 contacts the intermediate transfer belt 501 at a position where the intermediate transfer belt 501 is movably positioned around a cleaning facing roller 511. It is also possible to switch a state of the belt cleaning blade 504 between a state of being in contact with the intermediate transfer belt 501 and that of being spaced from the intermediate transfer belt 501 by utilizing a spacing/contacting mechanism (now shown).

The belt discharger 503 and the belt cleaning blade 504 are controlled to be turned on or off as described below. If a full-color image is to be formed on a paper sheet, the belt discharger 503 is turned on after a completion of a secondary transfer and is kept turned on at least until the intermediate transfer belt 501 completes a one-cycle rotation so that the belt cleaning blade 504 is in contact with the intermediate transfer belt 501 for this one-cycle rotation period. If a full-color image is to be formed repeatedly, the belt discharger 503 is turned on after the completion of a secondary transfer and is kept turned on until a leading edge of a next toner image reaches a discharging position and a cleaning position, respectively, so that the belt cleaning blade 504 is in contact with the intermediate transfer belt 501 for this period. Furthermore, if a monochrome-color image is to be formed on a paper sheet, the belt discharger 503 is turned on after a completion of the primary transfer and is kept turned on at least until the intermediate transfer belt 501 completes a one-cycle rotation, so that the belt cleaning blade 504 is in contact with the intermediate transfer belt 501 for this one-cycle rotation period. If the monochrome-color image is to be formed repeatedly, the belt discharger 503 is turned on after the completion of the primary transfer and is kept turned on until the leading edge of a next toner image reaches the discharging position and the cleaning position, respectively, so that the belt cleaning blade 504 is in contact with the intermediate transfer belt 501 for this period.

The lubricant applying brush 505 is used to apply fine particles, obtained, for example, by abrading zinc stearate 506 as a lubricant molded in a plate, to the intermediate transfer belt 501. This lubricant applying brush 505 can also be constructed to contact or separate from the intermediate transfer belt 501, and lubricant applying brush 505 can be controlled to be in contact with the intermediate transfer belt 501 at a desired timing.

The paper transfer unit 600 includes a secondary transfer belt 601 movably positioned around three supporting rollers 602, 603, 604. A suspended portion of the secondary transfer belt 601 between the supporting rollers 602 and 603 contacts the intermediate transfer belt 501 at the secondary transfer facing roller 510. One of the three supporting rollers 602, 603, 604 is a driving roller rotation driven by a driving device (not shown), and the secondary transfer belt 601 is driven by this driving roller.

A secondary transfer bias roller 605 is disposed to attract the intermediate transfer belt 501, a transfer paper sheet, and the secondary transfer belt 601 between the secondary transfer facing roller 510 and the secondary transfer has roller 605, by applying a transfer bias of a predetermined current level by a secondary transfer power supply 802 controlled to be at a constant current. In addition, a spacing/contacting mechanism (not shown) can be provided for driving the supporting roller 602 and the secondary transfer bias roller 605 so that the secondary transfer belt 601 and the secondary transfer bias roller 605 can be located either separated from or in contact with the intermediate transfer belt 501. A position of the secondary transfer belt 601 separated from the spaced position is represented by a two-dots-and dash line in FIG. 1.

A transfer paper discharger 606 and a belt discharger 607 are provided facing each other at a position where the secondary transfer belt 601 is movably positioned around the supporting roller 603 at a side of fixing rollers 701. Further, a cleaning blade 608 is provided to clean the secondary transfer belt 601.

The transfer paper discharger 606 removes any charge remaining on a transfer paper sheet so that the transfer paper sheet can be separated from the secondary transfer belt 601 by a stiffness of the transfer paper sheet. The belt discharger 607 removes any charge generated by the secondary transfer bias roller 605 and remaining on the secondary transfer belt 601. The cleaning blade 608 removes deposits from a surface of the secondary transfer belt 601 for a cleaning.

In a color copying machine having the above-mentioned construction, when an image formation cycle is started, the photoconductive drum 100 is rotated by a driving motor (not shown) in a counterclockwise direction indicated by an arrow, and then the intermediate transfer belt 501 is rotated by the driving roller in a clockwise direction indicated by an arrow. Together with this rotation of the intermediate transfer belt 501, Bk, C, M, and Y toner images are formed on the photoconductive drum 100, and the formed toner images are then superimposed onto the intermediate transfer belt 501, e.g., in an order of Bk, C, M, and Y, so as to form a full-color toner image on the intermediate transfer belt 501.

The Bk toner image is formed as follows. The charger 200 is used to uniformly charge the photoconductive drum 100 to a predetermined potential with a negative charge by corona discharging. Subsequently, an optical writing unit is used to perform raster exposure based on Bk color image signals. When the raster image is exposed, a charge proportional to an amount of light exposure is removed and a Bk electrostatic latent image is thereby formed in an exposed portion of the photoconductive drum 100. Then, contact between Bk toner charged to a negative polarity on the Bk developing roller and the Bk electrostatic latent image inhibits toner from sticking to a portion where a charge on the photoconductive drum 100 remains, and thereby causes the Bk toner to stick to a portion where there is no charge on the photoconductive drum 100, in other words a portion exposed to the raster light exposure, so that a Bk toner image is formed of the electrostatic latent image. Then, the Bk toner image formed on the photoconductive drum 100 is transferred to a surface of the intermediate transfer belt 501 driven at an equal speed in contact with the photoconductive drum 100.

Any remaining toner which has not been transferred from the photoconductive drum 100 to the intermediate transfer belt 501 is cleaned by the photoconductive element cleaner 300 in preparation for a next image forming operation on the photoconductive drum 100.

The operation then proceeds to a C image forming process after the Bk image forming process in which C image data is read by a color scanner at a predetermined timing, and a C electrostatic latent image is formed by a write operation with laser light based on the C image data. After the trailing edge of the Bk electrostatic latent image passes a developing position and before the leading edge of the C electrostatic latent image reaches the developing position, the revolver type developing unit 400 is rotated so that the C developing device 402 is set in the developing position, and the C electrostatic latent image is then developed with C toner. Development of the C electrostatic latent image area is then continued and when the trailing edge of the C electrostatic latent image passes the developing position, the revolver type developing unit 400 is again rotated, and then the subsequent M developing device M is moved to the developing position. This rotation operation is also completed before the leading edge of the subsequent M electrostatic latent image reaches the developing position.

As for the M and Y image forming processes, the operations of reading color image data, forming an electrostatic latent image, and then development are the same as for the processes of Bk and C. Therefore, a further explanation is omitted.

In this way, Bk, C, M, and Y toner images sequentially formed on the photoconductive drum 100 are transferred sequentially to the intermediate transfer belt 501. By this operation, a toner image of up to four colors superimposed on the intermediate transfer belt 501 can be formed. The superimposed toner image on the intermediate transfer belt 501 is charged uniformly by the PTC 502, and is then transferred to a transfer paper sheet in a next secondary transfer process.

When the image forming operation is started, the transfer paper sheet is fed from a feeding section, such as a paper cassette or a manual feeding tray (not shown), and is put in a waiting state at a nip between a pair of registration rollers (not shown). Then, when the leading edge of the toner image on the intermediate transfer belt 501 reaches a secondary transfer section at which a nip is formed by the secondary transfer facing roller 510 and the secondary transfer bias roller 605, the not shown pair of registration rollers are driven so that the front edge of the transfer paper sheet is aligned with the leading edge of the toner image formed on the intermediate transfer belt 501, to perform registration between the transfer paper sheet and this toner image. The transfer paper sheet then passes through the secondary transfer section superposed with the toner image on the intermediate transfer belt 501. At this point, the toner image of four colors on the intermediate transfer belt 501 is transferred to the transfer paper sheet by a transfer bias applied from the secondary transfer bias roller 605.

When the transfer paper sheet passes through a portion facing the transfer paper discharger 606 disposed downstream of the secondary transfer section in a moving direction of the secondary transfer belt 601, a charge on the transfer paper sheet is removed and then the transfer paper sheet is peeled off from the secondary transfer belt 601 to be delivered to the pair of fixing rollers 701. Furthermore, a toner image is then fixed with fusion at a nip portion between the pair of fixing rollers 701, and the transfer paper is then discharged outside of a main body of the apparatus by a pair of discharging rollers (not shown) and is stacked in a copy tray (not shown) with a front side up, so as to obtain a full-color copy.

Further, toner remaining on the surface of the intermediate transfer belt 501 after the toner image is transferred to the transfer paper is cleaned by the belt cleaning blade 504 which contacts the intermediate transfer belt 501 by a spacing/contacting mechanism (not shown).

If the copying operation is repeated, in order to perform an operation of the color scanner and an image formation onto the photoconductive drum 100, an operation proceeds to an image forming process of a first color (Bk) of a second sheet at a predetermined timing subsequent to an image forming process of the fourth color (Y) of the first sheet. As for the intermediate transfer belt 501, a Bk toner image of the second sheet is transferred to the intermediate transfer belt 501 in an area which has been cleaned by the belt cleaning blade 504 subsequent to a transfer process of the toner image of four colors on the first sheet to the transfer paper. Then, the same operations are performed for a next sheet as for the first sheet.

Operations have been described in a copy mode in which full-color copies of four colors are obtained. The same operations are performed a number of corresponding times for specified colors in copy modes of three or two colors. In a monochrome-color copy mode, only the developing device of a predetermined color in the revolver type developing unit 400 is put in a development active state until the copying operation is completed for the predetermined number of sheets and the belt cleaning blade 504 contacts the intermediate transfer belt 501 while the copying operation is continuously performed.

Next, an explanation is provided for a control of the belt discharger 503 for removing a charge on the intermediate transfer belt 501 after the secondary transfer.

Referring to FIG. 4, a block diagram of a discharging control system is shown which includes a control section 900 for controlling a discharging of the intermediate transfer belt 501 by the discharger 503. In FIG. 4, the control section 900 includes a CPU 901, a ROM 902, a RAM 903, and an I/O interface 904. The I/O interface 904 is connected to a discharging power supply 804, a driving motor 508*a* coupled to the belt driving roller 508 of the intermediate transfer belt 501, and a mark sensor 905 mounted on an inner circumferential surface of the intermediate transfer belt 501 for detecting a mark (not shown) for detecting a rotating position of the intermediate transfer belt 501.

The discharging power supply 804 applies a voltage having DC and AC components to the belt discharger 503. The discharging condition of the belt discharger 503 can be switched only by changing at least one of the levels of the DC and AC components in the applied voltage; in this embodiment, the apparatus has a construction in which the level of the DC component is switched by the control section 900 from a viewpoint of achieving an easy control.

The turning ON/OFF timing of the discharging power supply 804 for applying a voltage to the belt discharger 503 is set based on output signals of the mark sensor 905 for detecting a mark (not shown) for detecting a rotating position of the intermediate transfer belt 501.

One of the features of the present invention is that the intermediate transfer belt 501 can have a high resistance. Intermediate transfer belts with a relative lower resistance may have a problem particularly in the formation of magenta and cyan images that a superimposed image of magenta on cyan may not remain stably formed as the magenta toner may move and not stay on the cyan toner. Increasing the resistance of the intermediate transfer belt 501 can correct for such a problem. However, when the resistance of the intermediate transfer belt 501 is increased, a problem may result that the intermediate transfer belt 501 significantly retains any charge to its surface potential during the process of forming multicolor images; that is, the surface potential on the intermediate transfer belt 501 increases with each superposition of a color image and is retained in a cumulative effect.

More specifically, referring to FIGS. 5(*a*) and 5(*b*), timing charts are respectively shown illustrating an example of a change of a surface potential of the intermediate transfer belt 501 and the turning ON/OFF timing of the belt discharger 503 when a full-color copying operation is repeated twice to superimpose toner images of four colors on the intermediate transfer belt 501 having a high resistance. FIG. 5(*a*) indicates a surface potential $V_S$ of the intermediate transfer belt 501 measured by a potential sensor at a position facing the PTC 502 in FIG. 1; the levels indicated by reference numerals ①, ②, ③, and ④ correspond to surface potentials of portions where the primary transfer has been performed for the first, second, third, and fourth colors, respectively. As shown in FIG. 5(*a*), a positive charge is generated to a rear side of the intermediate transfer belt 501 first by the primary transfer bias roller 507 whenever the primary transfer is performed, and the surface potential of the photoconductive drum side of the intermediate transfer belt 501 tends to increase in negative polarity.

Particularly in a case of using an intermediate transfer belt 501 having a relatively high resistance in this embodiment, a charge which has been applied once is apt to be maintained on the intermediate transfer belt 501, which results in a remarkable rise of the surface potential on the intermediate transfer belt 501 with each successive color image formation described above. Thus, the surface potential of the intermediate transfer belt 501 is increased toward the negative polarity whenever the primary transfer is performed, and therefore the surface potential of the intermediate transfer belt 501 becomes uneven depending on the number of times primary transfer is effectuated, namely, the number of times of superimposing toner images on the intermediate transfer belt 501.

Therefore in this embodiment, the control section 900 is used to switch the discharging condition of the belt discharger 503 in proportion to the surface potential of the intermediate transfer belt 501, so that charges can be evenly removed. Specifically, the above-mentioned discharging power supply 803 is controlled so as to switch the level of the DC component of the output voltage according to the number of times of superimposing toner images on the intermediate transfer belt 501 to match the upper surface potential as shown in FIG. 5(*a*). If toner images are superimposed a lot of times, a charge is increasingly removed by increasing the level of the DC component output from the discharging power supply 803. If toner images are superimposed a few times, a charge is removed with a lower capability by relatively decreasing the level of the DC component to the situation mentioned above so that the intermediate transfer belt 501 is not charged to a negative polarity.

According to a feature of the present invention, if only a monocolor image is formed on the intermediate transfer belt 501, the belt discharger 503 will receive a discharging voltage from the discharging power supply 803 to match the value shown as the ① in FIG. 5(*a*). If a full color image is formed on the intermediate transfer belt 501 by the superposition of four individual toner images, the belt discharger 503 will receive a discharging voltage from the discharging power supply 803 which equals the value shown by the ④ in FIG. 5(*a*). In this way, the discharging voltage provided to the belt discharger 503 will be proportional to the actual surface potential on the intermediate transfer belt 501. In the present invention the manner of determining this actual surface potential on the intermediate transfer belt 501 is to correlate the voltage provided to the belt discharger 503 to the number of individual toner images superposed onto the intermediate transfer belt 501. One example of actual values of these applied voltages to the belt discharger 503 is provided below.

As noted above, when a high resistance intermediate transfer belt 501 is used, the intermediate transfer belt 501 tends to retain charge. As a result, it may also be difficult to transfer the different color toner images from the photoconductive drum 100 to the intermediate transfer belt 501. As a result, a further feature of the present invention is to increase the voltage applied from the primary transfer bias roller 507 in correspondence with the number of toner images transferred from the photoconductive drum 100 to the intermediate transfer belt 501.

More specifically, as shown in FIG. 5(*c*), as a further feature of the present invention, the voltage Vout from the primary transfer bias roller 507 can be controlled to increase with each successive image transfer operation. As one specific example of this operation of the present invention, the transfer bias output by the primary transfer bias roller 507 under control of the primary transfer power supply 801 can be 1,000 V after a first image is transferred from the photoconductive drum 100 to the intermediate transfer belt 501, for example for the BK image. Then, when a next image in a color image formation is to be transferred from the photoconductive drum 100 to the intermediate transfer belt 501, the transfer bias output from the primary transfer bias roller 507 can be increased to 1,500 V, for example for the C image. Then, for the M and Y successive images the transfer bias output from the primary transfer bias roller 507 can be increased respectively to 2,000 V and 2,500 V. In this way, in this operation of the present invention the transfer bias output from the primary transfer bias roller 507 can increase in correspondence to the number of toner images transferred from the photoconductive drum 100 to the intermediate transfer belt 501 for one image formation.

Another problem which may arise in the device of FIG. 1 is that if a heavy paper is used as the image transfer sheet, such a heavy paper will require a longer fixing time. However, if a longer fixing time is required for such a heavy sheet of paper, the output of the PTC 502 should also be reduced to avoid excessive charging on the intermediate transfer belt 501.

In this way, according to a further feature of the present invention, if a carton board or other heavy paper, e.g., postcard, is used as a transfer paper sheet, a carton board mode is executed to switch a moving speed of the intermediate transfer belt 501 to approximately one half of that of a plain paper by controlling the driving motor 508*a* of the belt driving roller 508. If the moving speed of the intermediate transfer belt 501 is lowered in such a mode, a charge is apt to be more easily removed by the belt discharger 503. Therefore, in this embodiment, if the moving speed of the intermediate transfer belt 501 is also lowered in the carton board mode, the level of the DC component of the applied voltage is also lowered in comparison with that of plain paper so as to reduce a capability of removing charge in the discharging operation so that the intermediate transfer belt 501 is not charged to an inverted polarity.

According to this further feature of the present invention as described above, the level of the voltage (DC component) applied to the belt discharger 503 is switched according to the number of times of a transfer of toner image to the intermediate transfer belt 501 such that even if the surface potential of the intermediate transfer belt 501 is uneven before removing a charge therefrom due to the difference in the number of times of the transfer to the intermediate transfer belt 501, it is still possible to remove a charge evenly from the intermediate transfer belt 501. Furthermore, even if the surface potential of the intermediate transfer belt 501 is uneven before removing a charge due to a difference of a moving speed, for example if a carton board mode is executed which switches the moving speed of the intermediate transfer belt 501, it is possible to remove a charge evenly from the intermediate transfer belt 501. In this manner, a charge can be evenly removed from the intermediate transfer belt 501 so as to prepare for a transfer of a next toner image from the photoconductive drum 100.

In the aforementioned embodiment, the surface potential of the intermediate transfer belt 501 may also sometimes be uneven depending on whether or not the intermediate transfer belt 501 faces the bias roller 605 under a charging operation. In this case, it is preferable to evenly remove a charge from the intermediate transfer belt 501 by switching the level of the voltage (DC component) applied to the belt discharger 503 depending on whether or not the intermediate transfer belt 501 faces the bias roller 605 in the charging operation.

Particularly when the apparatus has a construction in which a transfer paper is directly put between the secondary transfer bias roller 605 and the secondary transfer facing roller 510 having an intermediate resistance to which a bias voltage of a positive polarity is applied without using the secondary transfer belt 601 having a relatively high resistance shown in FIG. 1, an absolute value of the surface potential of the intermediate transfer belt 501 becomes lower than that at a non-image portion, and therefore unevenness of the surface potential may easily occur at an image portion on the intermediate transfer belt 501, i.e., at a portion facing the secondary transfer bias roller 605 to which a predetermined transfer bias is applied. In this case, a level of the voltage (DC component) applied to the belt discharger 503 is switched depending on whether the secondary transfer bias roller 605 to which the transfer bias is applied faces an image portion or a non-image portion. For example, to remove a charge from the image portion facing the secondary transfer bias roller 605 to which the transfer bias is applied, the level of the DC voltage applied to the belt discharger 503 is switched to be lower than the voltage at non-image portions. This switching can be performed at a timing based on output signals of the mark sensor 905.

Next, an explanation will be made of a specific example of an embodiment of a color copying machine according to the above-mentioned embodiment.

As the intermediate transfer belt 501, a belt having a thickness of 0.15 mm, a width of 368 mm, and an inner circumferential length of 565 mm is used and the moving speed of the intermediate transfer belt 501 is set to 200 mm/sec.

The surface layer 501*a* of the intermediate transfer belt 501 is formed by an insulating layer having a thickness of approximately 1 $\mu$m, the intermediate layer 501*b* is formed by an insulating layer (volume resistivity of approximately $10^{13}$ Ωcm) having a thickness of approximately 75 $\mu$m made of PVDF (polyvinylidene fluoride), and the base layer 501*c* is formed by a middle resistance layer (volume resistivity of approximately $10^{8}$ to $10^{11}$ Ω) having a thickness of approximately 75 $\mu$m made of PVDF (polyvinylidene fluoride) and titanium oxide. As a result of measuring a volume resistivity of the entire intermediate transfer belt 501 made of these materials, $10^{7}$ to $10^{12}$ Ωcm of the volume resistivity is obtained. The above-described volume resistivities are measured by applying a voltage of 100 V for 10 seconds, using a measuring method described in JIS K 6911 (Japanese Industrial Standard; K 6911). In addition, by measuring a surface resistivity on a surface of the intermediate transfer belt 501 at the surface layer 501*a* side with an ohmmeter manufactured by Yuka Denshi, whose trade name is "High Rester IP", a level of $10^{7}$ to $10^{12}$ Ω/□ is obtained. This surface resistivity can be measured in a surface resistance measuring method described in JIS K 6911 in addition to a method of using the above-mentioned ohmmeter.

Furthermore, a nickel-plated metal roller is used as the primary transfer bias roller 507, a metal roller is used as the belt discharging roller 512, and metal rollers or conductive resin rollers are used for other rollers. To the primary transfer bias roller 507, an approximate (appropriate) level of a DC transfer bias is applied, such as, for example, 1.0 kV for a toner image of the first color, 1.3 to 1.4 kV to a toner image of the second color, 1.6 to 1.8 kV for a toner image of the third color, and 1.9 to 2.2 kV for a toner image of the fourth color.

A nip width Wn in the primary transfer section is set to 10 mm, and a distance L is set to 7 mm between the downstream end in the intermediate transfer belt 501 moving direction in the above-mentioned nip portion and the contact position of the belt discharging brush 513 (see FIG. 3). As the belt discharging brush 513, a conductive one in which carbon-containing resin fiber is planted is used.

As the PTC 502, a charger with a grid electrode is used. To the PTC 502, the discharging power supply 803 applies a DC bias voltage having a same polarity as the polarity of the charged toner image on the intermediate transfer belt 501. More specifically, a DC voltage is applied to be controlled at a constant current of −500 $\mu$A to main wire 502*a* of the PTC 502, and then a DC voltage set within a range of 0 to −3 kV is applied to the grid electrode 502*b*.

In addition, a DC component of the voltage applied to the belt discharger 503 is set as shown in Table 1 below. Furthermore, a voltage between peaks of an AC component is set to 6 kvp-p and a frequency is set to 500 Hz.

TABLE 1

APPLIED VOLTAGE TO BELT DISCHARGER 503 (DC COMPONENT)

| Superposition Count | Plain Paper | Carton Board |
|---|---|---|
| Once | 300 V | 220 V |
| Twice | 400 V | 280 V |
| Three times | 500 V | 340 V |
| Four times | 600 V | 400 V |

As the secondary transfer bias roller 605, a roller having a surface layer made of a conductive sponge or a conductive rubber and a core layer made of metal or a conductive resin is used, and a transfer bias is controlled at a constant current of 20 to 10 $\mu$A is applied to this roller. As the secondary transfer belt 601, a belt-shaped member made of PVDF (polyvinylidene fluoride) having a thickness of 100 $\mu$m and a volume resistivity of $10^{13}$ Ωcm is used.

As the transfer paper discharger 606, a discharger to which an AC voltage only or an AC plus DC voltage is applied by a power supply (not shown) is used, and as the belt discharger 607, a discharger to which an AC voltage only or an AC plus DC voltage is applied by a power supply (not shown) is used. The cleaning blade 608 is put in contact with the secondary transfer belt 601 at a portion where the cleaning blade 608 is suspended on the supporting roller 604 in a counter angle direction.

As discussed above with respect to the background image forming apparatus, if an image to be transferred includes both half tone and solid image portions, a transferring efficiency transferring both of these types of images may decrease, and an unevenness in a charging amount of the image transfer member may arise. That is, in the device of the present invention as discussed above with respect to FIG. 1 the toner image on the intermediate transfer belt 501 transferred from the photoconductive drum 100 may include halftone and solid portions, or portions having different amounts of superposed toner, and therefore a charged amount is sometimes uneven. Additionally in some cases, unevenness of the charged amount may occur in the toner image on the intermediate transfer belt 501 after the primary transfer due to a peeling discharge which occurs in a gap downstream adjacent to the primary transfer section in the moving direction of the intermediate transfer belt 501. This unevenness of charged amount in a single toner image decreases a transfer allowance in the secondary transfer section for transferring the toner image from the intermediate transfer belt 501 to the transfer paper.

According to a further feature of the present invention, unevenness of a charged amount in a single toner image is dissolved by evenly charging the toner image which has not been transferred yet to the transfer paper by the PTC 502, so as to improve a transfer allowance in the secondary transfer section.

According to this feature, the toner image on the intermediate transfer belt 501 transferred from the photoconductive drum 100 is evenly charged by the PTC 502, whereby it becomes possible to keep the transfer characteristics in the secondary transfer section almost constant in all portions of the toner image on the intermediate transfer belt 501, even if there is unevenness of the charged amount in the toner image on the intermediate transfer belt 501. Therefore, the transfer allowance at a transfer to the transfer paper can be inhibited from being decreased, so that the toner image can be stably transferred.

In the above embodiment, the charged amount with the PTC 502 also depends on a moving speed of the intermediate transfer belt 501. For example, if the moving speed of the intermediate transfer belt 501 is relatively low, the same portion of the toner image on the intermediate transfer belt 501 passes through a charged area with the PTC 502 for a longer period of time, and therefore the charged amount becomes greater. On the contrary, if the moving speed of the intermediate transfer belt 501 is high, the charged amount of the toner image on the intermediate transfer belt 501 becomes lower. Therefore, if the moving speed of the intermediate transfer belt 501 passes through the position where it is charged by the PTC 502, it is preferable to control the PTC 502 so that the charged amount to the toner image does not change in the middle, depending on the moving speed of the intermediate transfer belt 501.

If a carton board is used as transfer paper in the color image forming apparatus in this embodiment, the carton board mode is selected for execution, by which the operation speed of the entire apparatus is switched in the middle (along the way) of the image forming operation so that the secondary transfer to the transfer paper and a fixing operation afterward can be preferably performed under a condition that the copying speed (CPM) is not lowered if possible. Specifically, after a trailing edge of the toner image on the photoconductive drum 100 is transferred to the intermediate transfer belt 501 and before a leading edge of the toner image on the intermediate transfer belt 501 reaches the secondary transfer section, the moving speed of the intermediate transfer belt 501 is switched to the about one-half when the carton board mode is to be executed. If the carton board mode is executed, the moving speed of the intermediate transfer belt 501 changes while the toner image on the intermediate transfer belt 501 passes through the charged position with the PTC 502. Therefore, it is preferable to control the PTC 502 according to the moving speed of the intermediate transfer belt 501 so that the charged amount to the toner image does not change in the middle of the passage.

Referring to FIGS. 6(*a*) and 6(*b*), timing charts are shown respectively illustrating a control of the driving motor 508*a* for the intermediate transfer belt 501 and that of a grid voltage of the PTC 502 in the above carton board mode. In FIGS. 6(*a*) and 6(*b*), after the copying operation is started at a timing indicated by reference numeral A and before the leading edge of the toner image on the intermediate transfer belt 501 reaches the charged position with the PTC 502 (reference numeral B in FIG. 6), a charging operation with the PTC 502 is started. Subsequently, based on a result of detecting a mark on the intermediate transfer belt by the mark sensor 905, a judgment is made for a timing that the trailing edge of the toner image on the photoconductive drum 100 is transferred to the intermediate transfer belt 502 and before the leading edge of the toner image on the intermediate transfer belt 501 reaches the secondary transfer section (reference numeral C in FIG. 6). At this timing, the moving speed of the intermediate transfer belt 501 is reduced to about one-half by controlling the belt driving motor 508*a*. Simultaneously with this control, the PTC power supply 803 is controlled to reduce the grid voltage to be applied to the grid electrode 502*b* of the PTC 502 to about one-half to lower the charging capability of the PTC 502. This operation inhibits the charged amount of the toner image on the intermediate transfer belt 501, which has been charged by the PTC 502, from being changed by a reduction of the moving speed of the intermediate transfer belt. Then, at a timing (reference numeral D in FIG. 6) when the trailing edge of the toner image on the intermediate transfer belt 501 passes through the charging position with the PTC 502, an application of a bias voltage to the PTC 502 is stopped.

Thus, as described above, even if the moving speed of the intermediate transfer belt 501 changes during the charging of the toner image on the intermediate transfer belt 501 with the PTC 502 as a result of an execution of a carton board mode or the like, the toner image on the intermediate transfer belt 501 can be evenly charged over the entire surface, so as to reliably prevent a transfer allowance from being reduced.

As also discussed above, one drawback with the device of FIG. 1 is that it requires the use of both a cleaning blade 504 and a belt discharger 503. A further feature of the present invention as shown in FIG. 7 is to utilize one conductive brush roller 514 which performs the functions of both the belt discharger 503 and the cleaning blade 504. In this way, the further embodiment of FIG. 7 is identical to that of FIG. 1 except that the cleaning blade 504 and the belt discharger 503 of FIG. 1 are replaced by the conductive brush roller 514 and a discharging power supply 804 connected to the conductive brush roller 514.

The brush roller 514 is used for discharging and cleaning the intermediate transfer belt 501 after the secondary transfer, and the discharging power supply 804 applies a DC voltage having a same polarity as a surface potential of the intermediate transfer belt 501 after the secondary transfer to the brush roller 514. To the DC voltage, an AC voltage can be superposed so as to improve a discharging efficiency. In addition, for the brush roller 514, it is possible to use a spacing/contacting mechanism (not shown) to switch between a state of being put in contact with the intermediate transfer belt 501 and being spaced therefrom.

The brush roller 514 is controlled to be turned on or off as described below. In forming a full-color image on a paper sheet, the brush roller 514 is put into contact with the intermediate transfer belt 501 at least until the intermediate transfer belt 501 completes one rotation after the secondary transfer is completed. To form a full-color image repeatedly, the brush roller 514 is put into contact with the intermediate transfer belt 501 until a leading edge of a next toner image reaches a discharging position and a cleaning position after the secondary transfer is completed. Furthermore, to form a mono-color image on a paper sheet, the brush roller 514 is put into contact with the intermediate transfer belt 501 at least until the intermediate transfer belt 501 completes one rotation after the primary transfer is completed. To form a monochrome-color image repeatedly, the brush roller 514 is put into contact with the intermediate transfer belt 501 until a leading edge of a next toner image reaches the discharging position and the cleaning position after the primary transfer is completed.

Moreover, on the surface of the intermediate transfer belt 501 after the toner image is transferred to the transfer member, charges are removed simultaneously with cleaning by the brush roller 514 which is pressed against the intermediate transfer belt 501 by the not shown spacing/contacting mechanism.

According to this further feature of the present invention, it is possible to remove charges on the intermediate transfer belt 501 in addition to cleaning by utilizing a single brush roller 514 in contact with the intermediate transfer belt 501, whereby a lower cost can be achieved in comparison with an apparatus in which a discharging device and a cleaning device for the intermediate transfer belt 501 are individually constructed.

If a corona discharger is used as an intermediate transfer discharging device as in a background image forming apparatus, a phenomenon may occur that a surface of the intermediate transfer belt 501 is at about 0 V immediately after discharging though a potential of the polarity set before the discharging gradually begins to appear in a short time. As described in this embodiment, by using a construction in which a voltage is applied to the brush roller 514 for discharging, it is possible to inhibit an appearance of the potential of the polarity set before the discharging, by which preferable discharging characteristics can be achieved.

Figure 8:
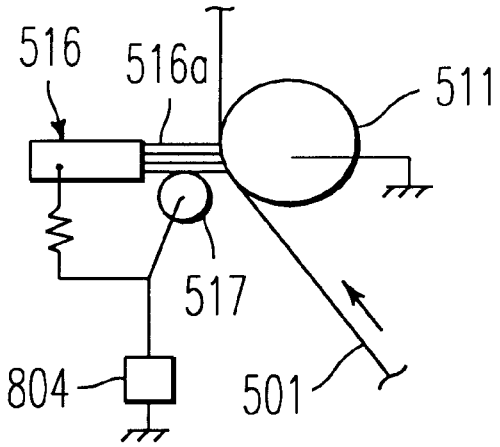
FIG. 8 shows a combination of a discharging device and a cleaner according to a further embodiment of the present invention.
Figure 9:
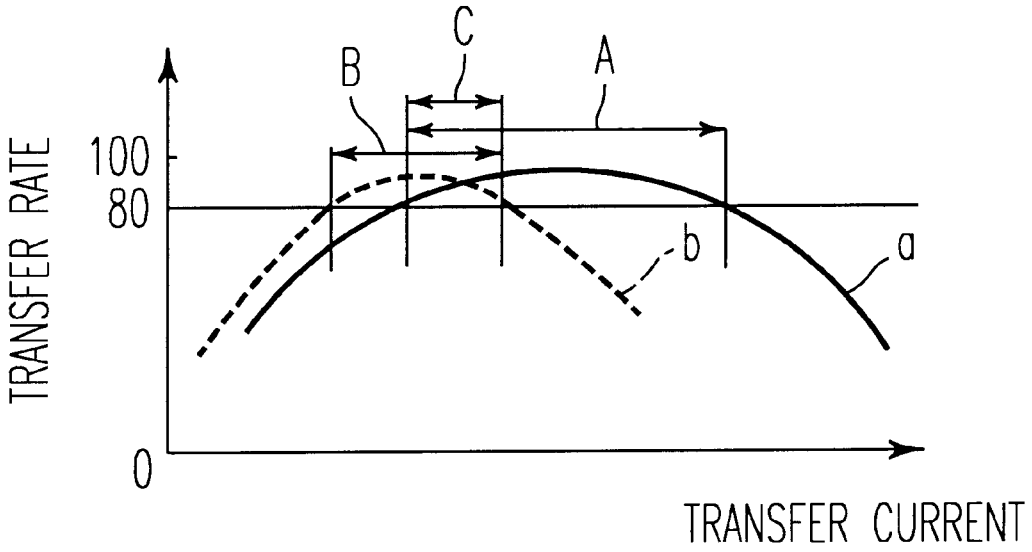
FIG. 9 shows a relationship between a transfer rate and a transfer current in an image forming device.

Although the brush roller 514 is used as a conductive brush member for discharging and cleaning the intermediate transfer belt 501 in the above embodiment, it is possible, as shown in FIG. 8, to use a conductive brush member 516 including a brush 516*a* which extends in an axial direction of a cleaning opposite roller 511. In this construction, it is preferable to construct a metal roller 517 for efficiently collecting toner adhering to the brush 516*a* of the brush member 516 in contact with the brush 516*a* as shown in FIG. 8. A higher voltage than that of the brush member 516 is applied to metal roller 517 so that the metal roller 517 adsorbs toner adhering to the brush 516*a* of the brush member 516 by an electrostatic force. Deposits adhering to the surface of the metal roller 517 can be collected by using a blade or the like (not shown).

In this embodiment, it is also possible to employ a construction in which charges on the intermediate transfer belt 501 can be evenly removed by switching the discharging condition for the brush roller 514 according to the surface potential of the intermediate transfer belt 501 after the secondary transfer, as discussed above with respect to discharger 503. Again, a level of the DC component of the output voltage of the discharging power supply 804 can be switched according to the number of times of superposition of toner images on the intermediate transfer belt 501.

Furthermore, as a brush roller 514 for discharging and cleaning the intermediate transfer belt 501 after the secondary transfer, a roller can be used in which conductive fiber is planted on a metallic shaft. A DC voltage (a plus voltage) having a polarity opposite to that of a surface potential of the intermediate transfer belt 501 can be applied to the shaft before discharging. By using the conductive brush roller 514 to which this predetermined voltage is applied, it is possible to preferably remove charges from the intermediate transfer belt 501 after the secondary transfer without an occurrence of a phenomenon that charges once removed begin to appear on the surface again even when using the intermediate transfer belt 501 in a multi-layer construction including an intermediate layer 501*b* having a relatively high resistance as described above.

Although the photoconductive drum 100 is used as an image bearing member in the description of the abovementioned embodiment, the present invention is also applicable to an apparatus containing an image bearing member having any other shape. For example, the invention is applicable to an endless photoconductive belt movably positioned between two rollers.

Although the intermediate transfer belt 501 is used as an intermediate transfer member in the description of the above-mentioned embodiment, the present invention is also applicable to an apparatus containing an intermediate transfer member having any other shape. Additionally, it is possible to select appropriate conditions such as electric characteristics (volume resistivity, surface resistivity, etc.), a thickness, a structure (a single layer, two layers, - - - ), materials, a quality of the materials, and the like of the intermediate transfer belt 501, based on the image forming conditions.

Although a discharging brush 505 is used as the primary transfer section discharging device in the nip portion of the primary transfer section in the description of the above-mentioned embodiment, the present invention is applicable to an apparatus containing a primary transfer section discharging device having any other shape such as a blade or a roller. The position at which a charge is removed by the discharging brush 505 is not limited to the position shown in the above-mentioned embodiment, however, it is only required to be in the nip portion in the primary transfer section upstream of the primary transfer bias roller 507 in the moving direction of the intermediate transfer belt 501. In addition, the discharging position in the nip portion in the primary transfer section is not limited to one place, but it is possible to remove a charge at a plurality of places. Furthermore, although the discharging brush 505 is grounded in this embodiment, it is possible to apply a bias having a polarity opposite to the polarity of a transfer charge as long as it does not affect the transfer charge required for the transfer at the above-mentioned nip portion.

Although the primary transfer bias roller 507 is used as the primary transfer charger in the description of the above-mentioned embodiment, the present invention is applicable to an apparatus containing a primary transfer charger having any other shape. In addition, a primary transfer charge can be applied at the nip portion of the primary transfer section on a condition that it is performed downstream from the position at which a charge is removed by the primary transfer section discharging brush 505 in the moving direction of the intermediate transfer belt 501.

In the above-mentioned embodiment, the values of the voltage and the current of the primary transfer bias applied to the primary transfer bias roller 507 are not limited to those in the above-mentioned example, but they can be set to appropriate values according to various image forming conditions.

Although the belt discharging roller 512 is used as the primary pre-transfer discharging device in the description of the above-mentioned embodiment, the present invention is applicable to an apparatus containing a member having any other shape such as a blade or a brush instead of this roller.

Although the secondary transfer bias roller 605 is used as the secondary transfer charger in the description of the above-mentioned embodiment, the present invention is applicable to an apparatus containing a member having any other shape such as a blade or a brush instead of this roller.

Although the secondary transfer belt 601 is used as the transfer member carrier for carrying a transfer member in the secondary transfer section in the above-mentioned embodiment, the present invention is also applicable to an apparatus containing a member having any other shape such as a drum instead of this belt.

Although the discharging potential of the photoconductive drum 100 has a negative polarity and there are provided developing devices used in a reversal development method in which two-component developer is used in the description of the above-mentioned embodiment, the present invention is not limited to the discharging potential of the photoconductive drum 100 and it is also applicable to an apparatus in which one-component developer is used or a regular development method is applied.

Obviously, numerous additional modifications and variations of the present invention are possible in light of the above teachings. It is therefore to be understood that within the scope of the appended claims, the present invention may be practiced otherwise than as specifically disclosed herein.

The present application is based on Japanese Priority documents 9-098064, 9-098065 and 9-098067, the contents of which are incorporated herein by reference.

What is claimed as new and desired to be secured by Letters Patents of the United States is:

1. An image forming apparatus including:

an intermediate transfer member carrying a toner image transferred from an image bearing member;

a primary transfer member applying a charge to the intermediate transfer member to transfer the toner image from the image bearing member to the intermediate transfer member;

a control section controlling a discharging of the intermediate transfer member based on a determined surface potential of the intermediate transfer member;

a discharger applying a discharging charge to the intermediate transfer member to remove a surface potential from the intermediate transfer member after a toner image is transferred from the intermediate transfer member to a final transfer member, wherein the discharging charge is proportional to the determined surface potential of the intermediate transfer member.

2. An image forming apparatus according to claim 1, wherein the toner image transferred from the image bearing member is superposed onto said intermediate transfer member by a plurality of transferring operations, and wherein the discharging charge applied from the intermediate transfer member discharger is switched based on a number of the plurality of transferring operations of the toner image to the intermediate transfer member.

3. An image forming apparatus according to claim 1, wherein the discharger includes a corona discharger to which a voltage having DC and AC components is applied; and wherein said discharging charge switches a level of the DC component applied to the corona discharger.

4. An image forming apparatus according to claim 1, wherein the intermediate transfer member is a belt having at least first and second layers.

5. An image forming apparatus according to claim 1, wherein the discharger includes a conductive brush and a power supply for supplying a bias voltage of an opposite polarity to the surface potential of the intermediate transfer member to the conductive brush.

6. An image forming apparatus according to claim 5, wherein the conductive brush includes a rotatable conductive brush roller.

7. An image forming apparatus according to claim 1, further comprising a pre-transfer charger for charging the intermediate transfer member prior to transferring the toner image from the image bearing member to the intermediate transfer member.

8. An image forming apparatus including:

an intermediate transfer means for carrying a toner image transferred from an image bearing means;

a primary transfer means for applying a charge to the intermediate transfer means for transferring the toner image from the image bearing means to the intermediate transfer means;

a control means for controlling a discharging of the intermediate transfer means based on a determined surface potential of the intermediate transfer member;

a discharging means for applying a discharging charge to the intermediate transfer means for removing a surface potential from the intermediate transfer member after a toner image is transferred from the intermediate transfer means to a final transfer means, wherein the discharging charge is proportional to the determined surface potential of the intermediate transfer means.

9. An image forming apparatus according to claim 8, wherein the toner image transferred from the image bearing means is superposed onto said intermediate transfer means by a plurality of transferring operations, and wherein the discharging charge applied from the discharging means is switched based on a number of the plurality of transferring operations of the toner image to the intermediate transfer means.

10. An image forming apparatus according to claim 8, wherein the discharging means includes a corona discharger to which a voltage having DC and AC components is applied; and wherein the discharging charge switches a level of the DC component applied to the corona discharger.

11. An image forming apparatus according to claim 8, wherein the intermediate transfer means is a belt having at least first and second layers.

12. An image forming apparatus according to claim 8, wherein the discharging means includes a conductive brush and a power supply for supplying a bias voltage of an opposite polarity to the surface potential of the intermediate transfer means to the conductive brush.

13. An image forming apparatus according to claim 12, wherein the conductive brush includes a rotatable conductive brush roller.

14. An image forming apparatus according to claim 8, further comprising a pre-transfer charging means for charging the intermediate transfer means prior to transferring the toner image from the image bearing means to the intermediate transfer means.

15. An image forming apparatus including:

an intermediate transfer member carrying a toner image transferred from an image bearing member;

a primary transfer member applying a charge to the intermediate transfer member to transfer the toner image from the image bearing member to the intermediate transfer member;

a control section controlling a discharging of the intermediate transfer member based on a determined surface potential of the intermediate transfer member;

a discharger applying a discharging charge to the intermediate transfer member to remove a surface potential from the intermediate transfer member after a toner image is transferred from the intermediate transfer member to a final transfer member, wherein the discharging charge is proportional to the determined surface potential of the intermediate transfer member, and wherein the charge applied by the primary transfer member is switched based on a number of the plurality of transferring operations of the toner image to the intermediate transfer member.

16. An image forming apparatus according to claim 15, wherein the intermediate transfer member is a belt having at least first and second layers.

17. An image forming apparatus according to claim 15, wherein the discharger includes a conductive brush and a power supply for supplying a bias voltage of an opposite polarity to the surface potential of the intermediate transfer member to the conductive brush.

18. An image forming apparatus according to claim 17, wherein the conductive brush includes a rotatable conductive brush roller.

19. An image forming apparatus including:

an intermediate transfer member carrying a toner image transferred from an image bearing member;

a primary transfer member applying a charge to the intermediate transfer member to transfer the toner image from the image bearing member to the intermediate transfer member;

a control section controlling a discharging of the intermediate transfer member based on a determined surface potential of the intermediate transfer member;

a discharger applying a discharging charge to the intermediate transfer member to remove a surface potential from the intermediate transfer member after a toner image is transferred from the intermediate transfer member to a final transfer member, wherein the discharging charge is proportional to the determined surface potential of the intermediate transfer member;

a secondary transfer charger applying a transfer charge to transfer the toner image from the intermediate transfer member to the final transfer member, and wherein the discharging charge applied from the discharger is switched based on whether the intermediate transfer member faces said secondary transfer charger during a charging operation.

20. An image forming apparatus according to claim 19, wherein the discharger includes a corona discharger to which a voltage having DC and AC components is applied; and wherein said discharging charge switches a level of the DC component applied to the corona discharger.

21. An image forming apparatus according to claim 19, wherein the intermediate transfer member is a belt having at least first and second layers.

22. An image forming apparatus according to claim 19, wherein the discharger includes a conductive brush and a power supply for supplying a bias voltage of an opposite polarity to the surface potential of the intermediate transfer member to the conductive brush.

23. An image forming apparatus according to claim 22, wherein the conductive brush includes a rotatable conductive brush roller.

24. An image forming apparatus including:

an intermediate transfer member carrying a toner image transferred from an image bearing member;

a primary transfer member applying a charge to the intermediate transfer member to transfer the toner image from the image bearing member to the intermediate transfer member;

a control section controlling a discharging of the intermediate transfer member based on a determined surface potential of the intermediate transfer member;

a discharger applying a discharging charge to the intermediate transfer member to remove a surface potential from the intermediate transfer member after a toner image is transferred from the intermediate transfer member to a final transfer member, wherein the discharging charge is proportional to the determined surface potential of the intermediate transfer member;

a moving speed controller switching a moving speed of the intermediate transfer member based on a thickness of the final transfer member, and wherein the discharging charge applied from the discharger is switched based on the moving speed of said intermediate transfer member.

25. An image forming apparatus according to claim 24, wherein the discharger includes a corona discharger to which a voltage having DC and AC components is applied; and wherein said discharging charge switches a level of the DC component applied to the corolla discharger.

26. An image forming apparatus according to claim 24, wherein the intermediate transfer member is a belt having at least first and second layers.

27. An image forming apparatus according to claim 24, wherein the discharger includes a conductive brush and a power supply for supplying a bias voltage of an opposite polarity to the surface potential of the intermediate transfer member to the conductive brush.

28. An image forming apparatus according to claim 27, wherein the conductive brush includes a rotatable conductive brush roller.

29. An image forming apparatus including:

an intermediate transfer member carrying a toner image transferred from an image bearing member;

a primary transfer member applying a charge to the intermediate transfer member to transfer the toner image from the image bearing member to the intermediate transfer member;

a control section controlling a discharging of the intermediate transfer member based on a determined surface potential of the intermediate transfer member;

a discharger applying a discharging charge to the intermediate transfer member to remove a surface potential from the intermediate transfer member after a toner image is transferred from the intermediate transfer member to a final transfer member, wherein the discharging charge is proportional to the determined surface potential of the intermediate transfer member;

a pre-transfer charger for charging the intermediate transfer member prior to transferring the toner image from the image bearing member to the intermediate transfer member, and wherein an output of the pre-transfer charger is controlled based on a moving speed of the intermediate transfer member.

30. An image forming apparatus according to claim 29, wherein the intermediate transfer member is a belt having at least first and second layers.

31. An image forming apparatus according to claim 29, wherein the discharger includes a conductive brush and a power supply for supplying a bias voltage of an opposite polarity to the surface potential of the intermediate transfer member to the conductive brush.

32. An image forming apparatus according to claim 31, wherein the conductive brush includes a rotatable conductive brush roller.

33. An image forming apparatus including:

an intermediate transfer means for carrying a toner image transferred from an image bearing means;

a primary transfer means for applying a charge to the intermediate transfer means for transferring the toner image from the image bearing means to the intermediate transfer means;

a control means for controlling a discharging of the intermediate transfer means based on a determined surface potential of the intermediate transfer means;

a discharging means for applying a discharging charge to the intermediate transfer means for removing a surface potential from the intermediate transfer member after a toner image is transferred from the intermediate transfer means to a final transfer means, wherein the discharging charge is proportional to the determined surface potential of the intermediate transfer means, and wherein the charge applied by the primary transfer means is switched based on a number of the plurality of transferring operations of the toner image to the intermediate transfer means.

34. An image forming apparatus according to claim 33, wherein the intermediate transfer means is a belt having at least first and second layers.

35. An image forming apparatus according to claim 33, wherein the discharging means includes a conductive brush and a power supply for supplying a bias voltage of an opposite polarity to the surface potential of the intermediate transfer means to the conductive brush.

36. An image forming apparatus according to claim 35, wherein the conductive brush includes a rotatable conductive brush roller.

37. An image forming apparatus including:

an intermediate transfer means for carrying a toner image transferred from an image bearing means;

a primary transfer means for applying a charge to the intermediate transfer means for transferring the toner image from the image bearing means to the intermediate transfer means;

a control means for controlling a discharging of the intermediate transfer means based on a determined surface potential of the intermediate transfer means;

a discharging means for applying a discharging charge to the intermediate transfer means for removing a surface potential from the intermediate transfer member after a toner image is transferred from the intermediate transfer means to a final transfer means, wherein the discharging charge is proportional to the determined surface potential of the intermediate transfer means;

a secondary charging means for applying a transfer charge to transfer the toner image from the intermediate transfer means to the final transfer means, and wherein the discharging charge applied from the discharging means is switched based on whether the intermediate transfer means faces said secondary transfer charging means during a charging operation.

38. An image forming apparatus according to claim 37, wherein the discharging means includes a corona discharger to which a voltage having DC and AC components is applied; and wherein the discharging charge switches a level of the DC component applied to the corona discharger.

39. An image forming apparatus according to claim 37, wherein the intermediate transfer means is a belt having at least first and second layers.

40. An image forming apparatus according to claim 37, wherein the discharging means includes a conductive brush and a power supply for supplying a bias voltage of an opposite polarity to the surface potential of the intermediate transfer means to the conductive brush.

41. An image forming apparatus according to claim 40, wherein the conductive brush includes a rotatable conductive brush roller.

42. An image forming apparatus including:

an intermediate transfer means for carrying a toner image transferred from an image bearing means;

a primary transfer means for applying a charge to the intermediate transfer means for transferring the toner image from the image bearing means to the intermediate transfer means;

a control means for controlling a discharging of the intermediate transfer means based on a determined surface potential of the intermediate transfer means;

a discharging means for applying a discharging charge to the intermediate transfer means for removing a surface potential from the intermediate transfer member after a toner image is transferred from the intermediate transfer means to a final transfer means, wherein the discharging charge is proportional to the determined surface potential of the intermediate transfer means;

a moving speed control means for switching a moving speed of the intermediate transfer means based on a thickness of the final transfer means, and wherein the discharging charge applied from the discharger means is switched based on the moving speed of said intermediate transfer means.

43. An image forming apparatus according to claim 42, wherein the discharging means includes a corona discharger to which a voltage having DC and AC components is applied; and wherein the discharging charge switches a level of the DC component applied to the corona discharger.

44. An image forming apparatus according to claim 42, wherein the intermediate transfer means is a belt having at least first and second layers.

45. An image forming apparatus according to claim 42, wherein the discharging means includes a conductive brush and a power supply for supplying a bias voltage of an opposite polarity to the surface potential of the intermediate transfer means to the conductive brush.

46. An image forming apparatus according to claim 45, wherein the conductive brush includes a rotatable conductive brush roller.

47. An image forming apparatus including:

an intermediate transfer means for carrying a toner image transferred from an image bearing means;

a primary transfer means for applying a charge to the intermediate transfer means for transferring the toner image from the image bearing means to the intermediate transfer means;

a control means for controlling a discharging of the intermediate transfer means based on a determined surface potential of the intermediate transfer means;

a discharging means for applying a discharging charge to the intermediate transfer means for removing a surface potential from the intermediate transfer member after a toner image is transferred from the intermediate transfer means to a final transfer means, wherein the discharging charge is proportional to the determined surface potential of the intermediate transfer means;

a pre-transfer charging means for charging the intermediate transfer means prior to transferring the toner image from the image bearing means to the intermediate transfer means, and wherein an output of the pre-transfer charging means is controlled based on a moving speed of the intermediate transfer means.

48. An image forming apparatus according to claim 46, wherein the intermediate transfer means is a belt having at least first and second layers.

49. An image forming apparatus according to claim 46, wherein the discharging means includes a conductive brush and a power supply for supplying a bias voltage of an opposite polarity of the surface potential of the intermediate transfer means to the conductive brush.

50. An image forming apparatus according to claim 49, wherein the conductive brush includes a rotatable conductive brush roller.

* * * * *